US008105023B2

(12) United States Patent
Ikeda et al.

(10) Patent No.: US 8,105,023 B2
(45) Date of Patent: Jan. 31, 2012

(54) STEAM TURBINE

(75) Inventors: Kazutaka Ikeda, Tokyo (JP); Takashi Sasaki, Kanagawa (JP); Satoru Asai, Kanagawa (JP); Hitoshi Sakakida, Tokyo (JP); Kenji Kamimura, Kanagawa (JP); Ryohei Ogino, Kanagawa (JP); Yasushi Ooishi, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 1004 days.

(21) Appl. No.: 11/968,309

(22) Filed: Jan. 2, 2008

(65) Prior Publication Data

US 2008/0175706 A1 Jul. 24, 2008

(30) Foreign Application Priority Data

Jan. 9, 2007 (JP) ..... 2007-001325

(51) Int. Cl.
*F01D 11/12* (2006.01)

(52) U.S. Cl. ..... 415/170.1; 415/173.1; 415/173.4; 415/174.4

(58) Field of Classification Search ..... 415/170.1, 415/171.1, 173.1, 173.4, 173.5, 173.6, 173.7, 415/174.4, 174.5
See application file for complete search history.

(56) References Cited

U.S. PATENT DOCUMENTS

| | | | | |
|---|---|---|---|---|
| 3,300,180 | A * | 1/1967 | Tuttle et al. | 415/138 |
| 4,816,213 | A * | 3/1989 | Groenendaal, Jr. | 415/134 |
| 5,049,032 | A * | 9/1991 | Brandon | 415/170.1 |
| 5,362,072 | A * | 11/1994 | Dalton | 415/173.2 |
| 5,501,573 | A * | 3/1996 | Sanders | 415/173.5 |
| 6,547,522 | B2 | 4/2003 | Turnquist et al. | |
| 6,860,718 | B2 * | 3/2005 | Suzuki et al. | 415/173.5 |
| 7,001,145 | B2 | 2/2006 | Couture et al. | |
| 7,052,017 | B2 * | 5/2006 | Uchida et al. | 415/174.5 |
| 7,287,956 | B2 | 10/2007 | Bracken et al. | |
| 7,645,117 | B2 * | 1/2010 | Bracken et al. | 415/173.3 |
| 2004/0126225 | A1 | 7/2004 | Ghasripoor et al. | |
| 2006/0133928 | A1 | 6/2006 | Bracken et al. | |

FOREIGN PATENT DOCUMENTS

| | | | |
|---|---|---|---|
| CN | 1800589 | A | 7/2006 |
| JP | 2003-065076 | A | 3/2003 |

* cited by examiner

*Primary Examiner* — Igor Kershteyn
(74) *Attorney, Agent, or Firm* — Foley & Lardner LLP

(57) ABSTRACT

A steam turbine has: a casing; a rotor rotatably arranged in the casing; a nozzle diaphragm concentrically arranged with respect to the rotor, the nozzle diaphragm being engaged with the casing; moving blades arranged in circumferential direction on outer circumference of the rotor at positions adjacent to the nozzle diaphragm; seal strips circumferentially extending on tips of the moving blades, the seal strips protruding in radial outward direction; and an abradable structure rigidly connected to the nozzle diaphragm. The abradable structure faces the seal strips in radial direction at a facing surface, and has an abradable part made of an abradable material arranged at the facing surface.

9 Claims, 9 Drawing Sheets

STEAM TURBINE

CROSS REFERENCES TO RELATED APPLICATIONS

The present invention contains subject matter related to Japanese Patent Application No. 2007-001325, filed in the Japanese Patent Office on Jan. 9, 2007, the entire content of which is incorporated herein by reference.

BACKGROUND OF THE INVENTION

This invention relates to a steam turbine, and more particularly, to a leakage prevention structure for working fluid which is arranged on moving blade tip.

FIG. 9 shows a general steam turbine. A steam turbine 100 has a rotor 2 which is rotatably arranged in a casing 1. The rotor 2 is made to rotate by steam which is working fluid. In the casing 1, nozzle diaphragms 3 are fixed to form static parts together with the casing 1. Each of the nozzle diaphragms 3 has a plurality of nozzle blades 3*c* which are arranged in the steam path formed between a nozzle diaphragm outer ring 3*a* and a nozzle diaphragm inner ring 3*b*, which are annular members, and are arranged in the circumferential direction. The nozzle diaphragm outer ring 3*a* is fixed to the casing 1, and is substantially concentrically arranged with respect to the rotor 2.

On the outer circumference part of the rotor 2, at positions adjacent to the nozzle diaphragms 3 in the axial direction, a plurality of moving blades 4 are arranged in the circumferential direction with intervals provided therebetween, and configure a rotation part together with the rotor 2. Each of the moving blades 4 has an implantation part 4*a*, a moving blade effective part 4*b*, and a moving blade tip 4*c*. The implantation parts 4*a* are engaged with the outer circumference part of the rotor 2 to be implanted thereto. The moving blade effective parts 4*b* are arranged in the steam path. Steam outflowing from the nozzle blades 3*c* passes through the space around the moving blade effective parts 4*b* to perform work and generate rotational force. The moving blade tips 4*c* are structural members which are arranged on the outer circumference part of the respective moving blades 4. The moving blade tips 4*c* are in contact with the moving blade tips 4*c* of the adjacent moving blades 4 in the circumferential direction to form an annular member as a whole, and play a role of fixing the tips of the moving blade effective parts 4*b*. The nozzle diaphragm outer ring 3*a* is arranged to be extended to the moving blade tips 4*c* of the moving blades 4, and faces the moving blade tips 4*c* in the radial direction.

In the steam turbine 100, the paired nozzle diaphragm 3 and moving blades 4 form a turbine stage. Steam supplied to the steam turbine 100 is directed to the space between the nozzle blades 3*c* of the nozzle diaphragm 3 and has its flowing direction changed, and then is directed to the space between the moving blade effective parts 4*b* of the moving blades 4 to generate rotational force to the moving blades 4 and the rotor 2. In the steam turbine 100 shown in FIG. 9, there are shown two turbine stages each formed by a nozzle diaphragm 3 and moving blades 4, and the nozzle diaphragms 3 of the two stages are coupled by bolts 9 to be arranged.

In the steam turbine 100, between the rotation part formed by the rotor 2 and moving blades 4, and the static part formed by the casing 1 and nozzle diaphragms 3, flow of leakage is generated. When the amount of the flow leakage is high, the efficiency and output of the steam turbine 100 is lowered. Accordingly, it is required to reduce the clearance provided between the rotation part and the static part as much as possible. For this reason, there is a known structure in which, on the outer circumference part of the moving blade tips 4*c* of the moving blades 4, seal strips 4*d* which protrude in the radial outward direction and are arranged in the form of a circumference are provided, which reduces the clearance provided between the tip of the seal strips 4*d* and the nozzle diaphragm outer ring 3*a* facing the seal strips 4*d* as much as possible, suppressing the flow leakage. Furthermore, there is also known a structure in which, on the surface of the nozzle diaphragm outer rings 3*a* facing the seal strips 4*d*, a coating layer (abradable layer 3*d*) made of an abradable material being a free-machining material etc. is arranged, which makes the seal strips 4*d* cut the abradable layer 3*d*, making it possible to further reduce the clearance to suppress the amount of the flow leakage.

In the steam turbine, since the rotor and casing are heated to be deformed in the transient operation at the time of the start up and shut down, it is impossible to set up the clearance between the rotation part and the static part to the minimum by only taking the rated operation time into consideration. Furthermore, in case a contact is raised between the rotation part and the static part during the operation, the seal strips may be damaged due to the contact. In some cases, the seal strips may be seriously damaged. Therefore, it is desired to set up a configuration in which the seal structure can be repaired.

As a seal structure that reduces a flow leakage by employing the seal strips and abradable layer, there is conventionally known a technique which is disclosed in Japanese Patent Application Publication No. 2003-65076 (the entire content of which is incorporated herein by reference). In this conventional technique, on the inner circumference side of the nozzle diaphragm outer ring which faces the seal strips arranged on the moving blade tips, a plurality of seal support member segments, each in the form of an arch, having the abradable layer are attached via springs. Employing this configuration, during the transient state of the turbine at the times of starts and stops, it becomes possible to shift the seal support member segments having the abradable layer in the radial outward direction.

However, under the seal structure using the seal strips and abradable layer of the conventional technique, the seal support member segments having the abradable layer are engaged with the nozzle diaphragm via springs, and are so arranged as to be able to shift in the radial direction. Accordingly, when seal fins come into contact with the abradable layer, especially in the transient state of the turbine at the times of starts and stops, there is raised an unstable behavior in which the seal support member segments jounce in the radial direction, which may raise a possibility that the seal fins and the abradable layer come into contact with each other widely and sometimes deeply. In this way, when the seal strips and the abradable layer come into contact with each other, there is a problem that, in the steady operation, the clearance at this part becomes large to increase the leak steam amount, and, furthermore, depending on the way of contact, the seal strips and abradable layer may be damaged.

Furthermore, under the seal structure of the conventional technique, since the seal support member segments are engaged with the nozzle diaphragm outer ring via springs such that the seal support member segments can shift in the radial direction, there is a disadvantage that, so as to keep the structural intensity of the nozzle diaphragm outer ring sufficiently, the nozzle diaphragm outer ring becomes large.

To prevent this problem, without employing the configuration in which the seal support member segments are engaged with the nozzle diaphragm outer ring via springs, as shown in FIG. 9, it can be considered that the abradable layer is directly arranged on the surface of the nozzle diaphragm outer ring 3*a* facing the seal strips 4*d* by the coating etc. By employing this configuration, the abradable layer 3*d* does not shift in the radial direction, which can reduce the part to be scraped away by the seal strips 4*d* to the minimum, making it possible to reduce the flow leakage. However, in the configuration shown in FIG. 9, since the nozzle diaphragm outer ring 3*a* of the respective stages having the abradable layer arranged on the inner circumference surface thereof is coupled by the bolts 9 to be unitedly formed, in case the seal strips 4*d* of a stage come into contact with the abradable layer 3*d* to damage the abradable layer 3*d*, the abradable layer 3*d* has to be repaired after detaching the entire nozzle diaphragm 3 of the stage, which raises another problem of making it difficult to repair the seal structure.

SUMMARY OF THE INVENTION

In view of the above-identified circumstances, it is therefore an object of the present invention to provide a seal structure for moving blade tips in which the maintainability is high even if the seal strips come into contact with the abradable layer to damage the abradable layer, and the leakage flow is reduced by preventing the abradable layer from being cut more than necessary, thereby making it possible to improve the efficiency of the steam turbine.

According to an aspect of the present invention, there is provided a steam turbine comprising: a casing; a rotor rotatably arranged in the casing; at least one nozzle diaphragm substantially concentrically arranged with respect to the rotor, the nozzle diaphragm being engaged with the casing; a plurality of moving blades arranged in circumferential direction on outer circumference of the rotor at positions adjacent to the nozzle diaphragm; one or more seal strips circumferentially extending on tips of the moving blades, the seal strips protruding in radial outward direction; and an abradable structure rigidly connected to the nozzle diaphragm, the abradable structure facing the seal strips in radial direction at a facing surface and having an abradable part made of an abradable material arranged at the facing surface.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which.

DETAILED DESCRIPTION OF THE INVENTION

Now, preferred embodiments of the present invention will be described by referring to the accompanying drawings.

Figure 1:
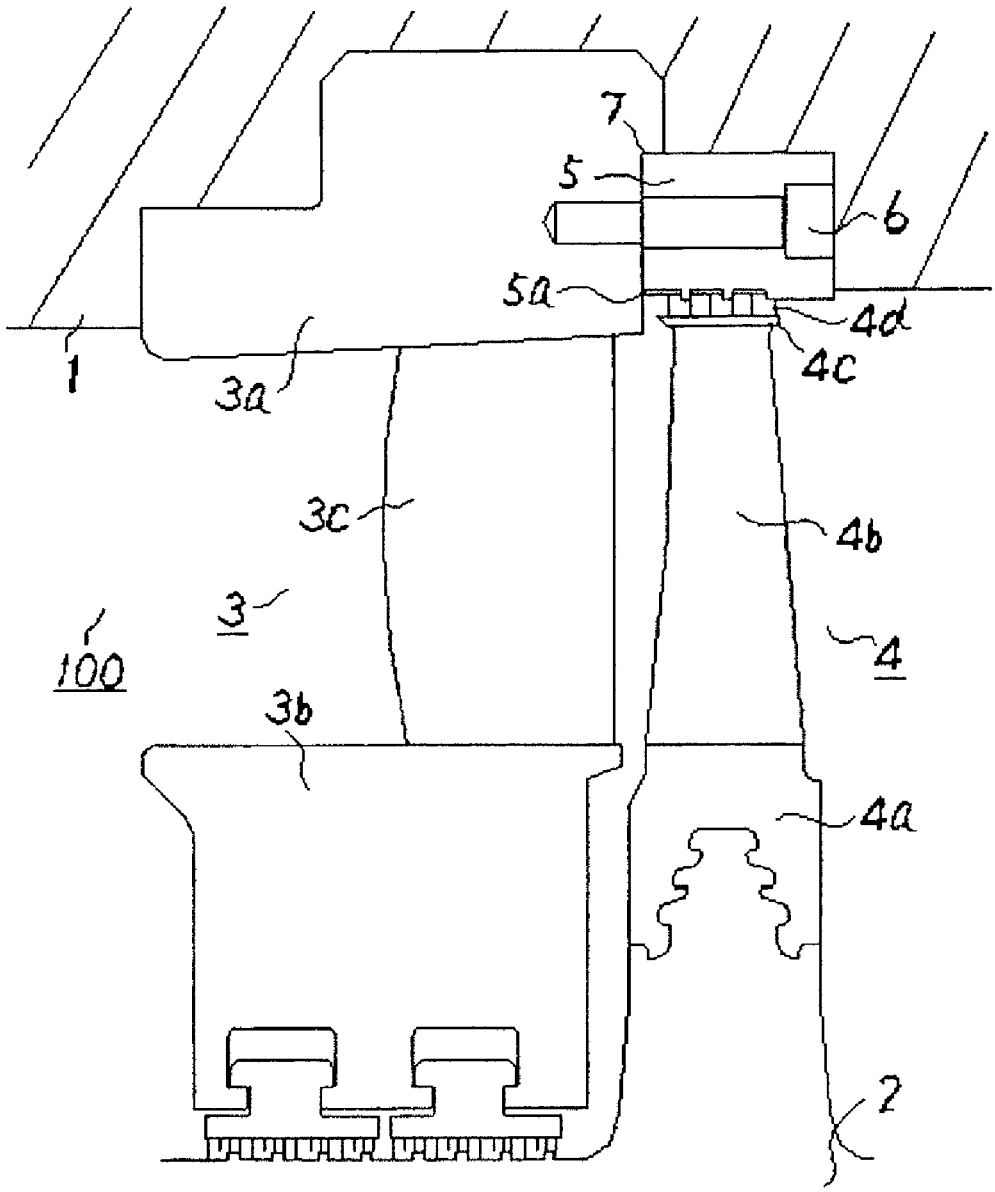
FIG. 1 shows a meridional sectional view showing a meridional plane being a cross section including the rotation axis of a stage of a steam turbine according to a first embodiment of the present invention.

FIG. 1 shows a meridional sectional view showing a meridional plane being a cross section including the rotation axis of a stage of a steam turbine according to a first embodiment of the present invention.

A steam turbine 100 has a rotor 2 which is rotatably arranged in a casing 1. The rotor 2 is made to rotate by steam which is working fluid. In the casing 1, nozzle diaphragms 3 are fixed to form a static part similarly to the casing 1. Each of the nozzle diaphragms 3 has a plurality of nozzle blades 3*c*. The nozzle blades 3*c* are arranged in the steam path formed between a nozzle diaphragm outer ring 3*a* and a nozzle diaphragm inner ring 3*b*, and are arranged in the circumferential direction. The nozzle diaphragm outer ring 3*a* is fixed to the casing 1, and is substantially concentrically arranged with respect to the rotor 2.

On the outer circumference part of the rotor 2, at positions adjacent to the nozzle diaphragms 3 in the axial direction, a plurality of moving blades 4 are arranged in the circumferential direction with intervals provided therebetween, and form a rotation part together with the rotor 2. Each of the moving blades 4 has an implantation part 4*a*, a moving blade effective part 4*b*, and a moving blade tip 4*c*. The implantation parts 4*a* are engaged with the outer circumference part of the rotor 2 to be implanted thereto. The moving blade effective parts 4*b* are arranged in the steam path. Steam outflowing from the nozzle blades 3*c* passes through the space between the moving blade effective parts 4*b* to perform work and generate rotational force. The moving blade tips 4*c* are structural members. The moving blade tips 4*c* are arranged on the outer circumference part of the respective moving blades 4, and are in contact with the moving blade tips 4*c* of the adjacent moving blades 4 in the circumferential direction to form an annular member as a whole, and play a role of fixing the tips of the moving blade effective parts 4*b*.

Figure 9:
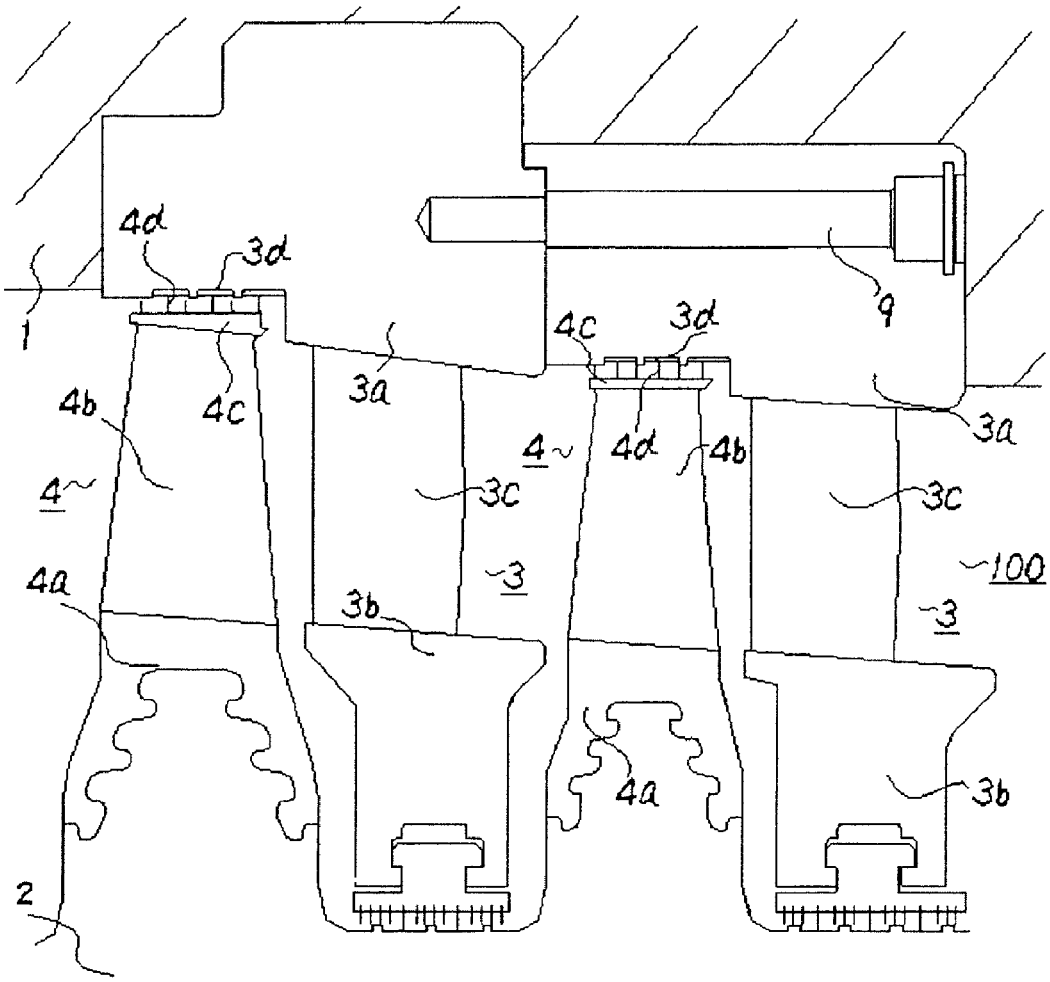
FIG. 9 PRIOR ART
FIG. 9 shows a meridional sectional view of turbine stages of a general steam turbine.

In the steam turbine 100, the paired nozzle diaphragm 3 and moving blade 4 form a turbine stage. Steam supplied to the steam turbine 100 is directed to the space between the nozzle blades 3*c* of the nozzle diaphragm 3 and has its flowing direction changed, and then is directed to the space between the moving blade effective parts 4*b* of the moving blades 4 to generate rotational force to the moving blades 4 and rotor 2. Similarly to the steam turbine shown in FIG. 9, also in the steam turbine 100 of the first embodiment according to the present invention shown in FIG. 1, there are arranged a plurality of turbine stages formed by the nozzle diaphragm 3 and moving blades 4, and the nozzle diaphragms 3 of the plural stages are coupled by bolts 6 to be arranged.

According to the steam turbine in this embodiment, an abradable structure 5 that has an abradable part 5*a* arranged on the inner circumference surface thereof is rigidly connected to the nozzle diaphragm outer ring 3*a* on the moving blade 4 side, and is arranged at a position facing the moving blade tips 4*c* in the circumferential direction. In this embodiment, a step portion 7 is formed on the outer circumference side of the nozzle diaphragm outer ring 3*a*. The abradable structure 5 is engaged with the step portion 7 to be positioned, and then the bolts 6 are screwed into bolt holes provided in the axial direction in this state. Accordingly, the abradable structure 5 is rigidly connected to the nozzle diaphragm outer ring 3*a*.

The connection method between the abradable structure 5 and the nozzle diaphragm outer ring 3*a* is not restricted to this, and, for example, they may be rigidly connected by arranging engagement parts so that they are engaged with each other without a jounce. The abradable part 5*a* is formed by directly performing coating, building-up, thermal spraying, etc. on the surface of the abradable structure 5.

As the material of the abradable part 5*a*, heretofore known various free-cutting materials can be used such as cobalt-nickel-chromium-aluminum-yttrium series material (CoNiCrAlY series material), nickel-chromium-aluminum series material (NiCrAl series material), and nickel-chromium-iron-aluminum-boron-nitrogen series material (NiCrFeAlBN series material).

On the outer circumference parts of the moving blade tips 4*c* of the moving blades 4, which face the abradable structure 5, seal strips 4*d* which protrude in the radial outward direction and are arranged in the form of a circumference are provided. In this embodiment, accordingly, the tips of the seal strips 4*d* and the abradable part 5*a* of the abradable structure 5 are made to face each other, and the seal strips 4*d* are made to cut the abradable parts 5*a* so as to reduce a clearance provided therebetween as much as possible, minimizing the flow leakage. The seal strips 4*d* are arranged on the moving blade tips 4*c*. The seal strips 4*d* can be arranged by unitedly cutting the moving blade tips 4*c*, or by embedding the seal strips 4*d* to the moving blade tips 4*c* by caulking etc. Furthermore, instead of arranging the seal strips 4*d*, by arranging knife-edges, similarly, the flow leakage can be reduced sufficiently.

Furthermore, in this embodiment, the inner circumference surface of the abradable structure 5, on which the abradable part 5*a* is arranged, is of the Hi-Low structure in which the height thereof (radius of inner circumference surface) is changed in the axial direction. In this way, by changing the height of the inner circumference surface of the abradable structure 5 in the axial direction, the leak flow can be further reduced.

As shown in FIG. 1, in this embodiment, the plural seal strips 4*d* are arranged on the moving blade tip 4*c*. All the clearances between the respective seal strips 4*d* and the abradable part 5*a* of the abradable structure 5 may be equal with each other, or may be different from each other depending on the design condition. For example, the clearances may be sequentially reduced from the upstream side.

With this configuration, since the abradable structure 5 is rigidly connected to the nozzle diaphragm outer ring 3*a*, that is, rigidly connected without using springs, the position of the abradable structure 5 with respect to the nozzle diaphragm 3 does not shift in the radial direction. Accordingly, even in the transient state, a situation in which the abradable layer jounces to be largely cut is scarcely raised. So, a part of the abradable part 5*a* to be scraped away can be suppressed to the minimum, which can further reduce the amount of steam leakage.

Furthermore, since the abradable structure 5 is separately arranged from the nozzle diaphragm 3, and is connected to the nozzle diaphragm outer ring 3*a* by the bolts 6 etc., the abradable structure 5 can be easily detached. Accordingly, when the seal strips 4*d* come into contact with the abradable part 5*a* to damage the abradable part 5*a*, the repair work therefor can be easily performed. Furthermore, in case of replacing the abradable part 5*a*, it is not necessary to replace the entire nozzle diaphragm 3 or the nozzle diaphragm outer ring 3*a*, and only the abradable structure 5 including the abradable part 5*a* has to be replaced, which can reduce a time period required for the maintenance.

Figure 2:
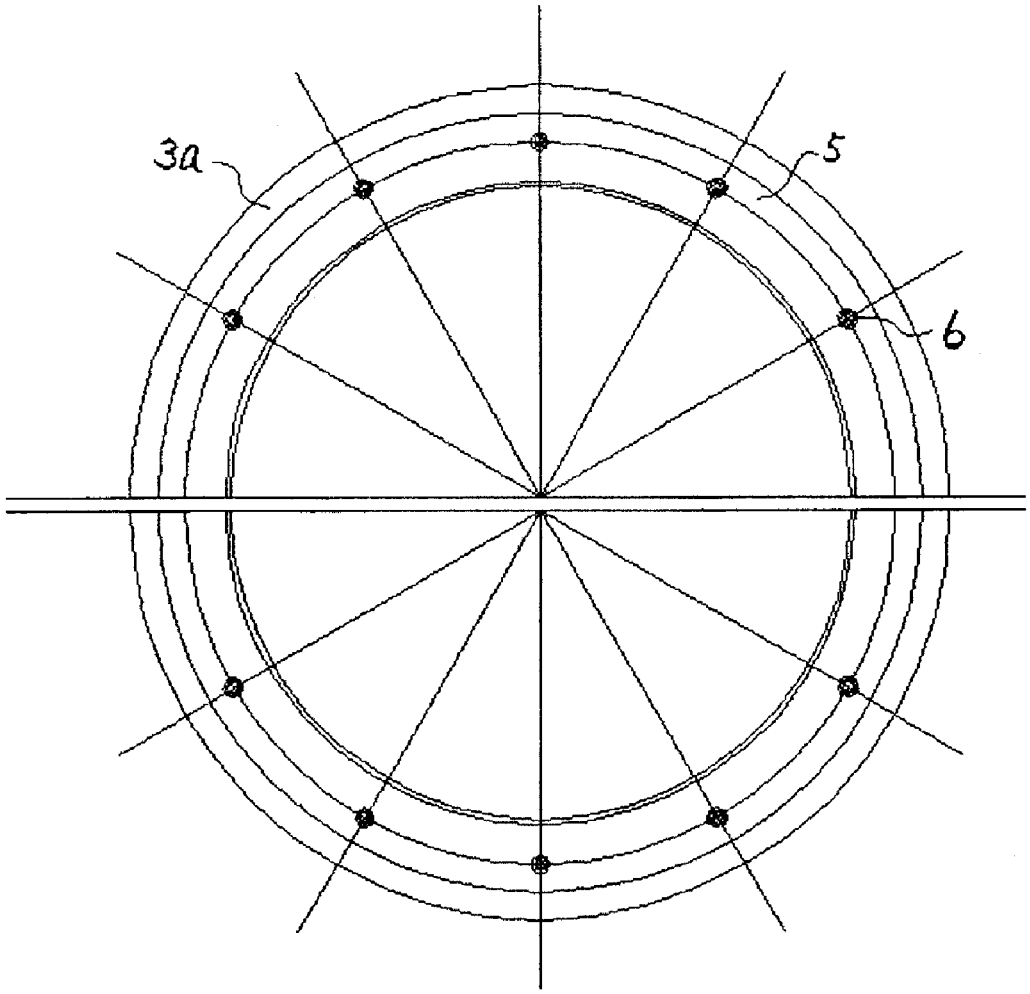
FIG. 2 shows a schematic view showing the connection state between an abradable structure and a nozzle diaphragm outer ring of the steam turbine according to the first embodiment of the present invention, which is viewed from the upstream side in the axial direction.
Figure 3:
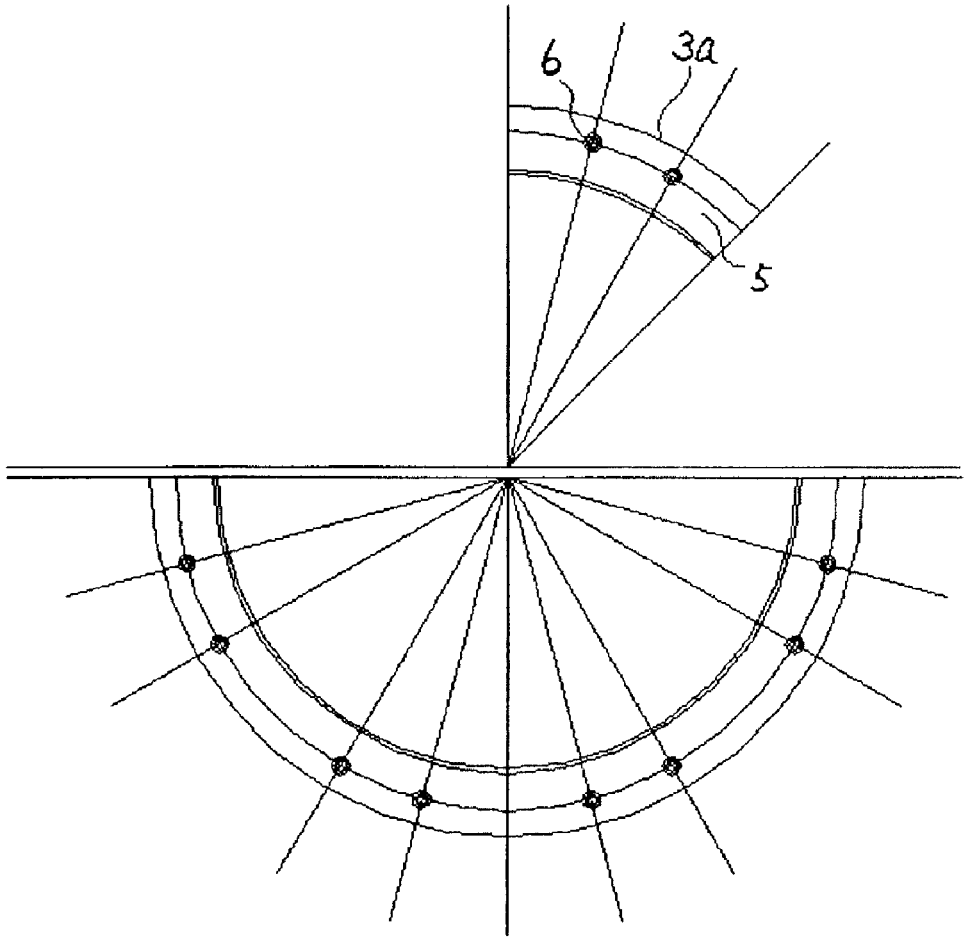
FIG. 3 shows a schematic view showing another example of the connection state between abradable structures and a nozzle diaphragm outer ring of the steam turbine according to the first embodiment of the present invention, which is viewed from the upstream side in the axial direction.

FIGS. 2 and 3 show schematic views indicative of the connection state between the abradable structure 5 and the nozzle diaphragm outer ring 3*a* shown in FIG. 1, which is viewed from the upstream side in the axial direction. In FIGS. 2 and 3, parts or components similarly to those shown in FIG. 1 are indicated by the same reference numerals, and repetitive explanation will be omitted.

As described above, the abradable structure 5 is rigidly connected to the nozzle diaphragm outer ring 3*a* by the bolts 6 which are arranged in the axial direction. Furthermore, as shown in FIG. 2, while the abradable structure 5 is arranged in the circumferential direction over the one circuit, in this embodiment, the abradable structure 5 is configured as a combination of upper and lower semicircular annular members which are combined in a horizontal plane. The plural bolts 6 are arranged in the circumferential direction with intervals provided therebetween, and, using the bolts 6, the abradable structure 5, which is separated into two parts, is rigidly connected to the upper half part and the lower half part of the nozzle diaphragm outer ring 3*a* in the axial direction. That is, in the example shown in FIG. 2, by separating the abradable structure 5 into the upper and lower parts, the number of parts can be reduced as much as possible.

Furthermore, as shown in FIG. 3, instead of the abradable structure 5 which is separated into the upper and lower parts in a horizontal plane, the abradable structure 5 which is separated into more than two parts can be employed by, for example, separating the abradable structure 5 into eight parts each of which is configured by the 45-degree parts of the one circuit thereof.

In this way, by separating the abradable structure 5 into plural parts in the circumferential direction, and rigidly connecting thus separately configured abradable structure 5 to the nozzle diaphragm outer ring 3*a* using the bolts 6, at the time of the maintenance, it becomes possible to replace only the damaged part of the abradable structure 5.

Figure 4:
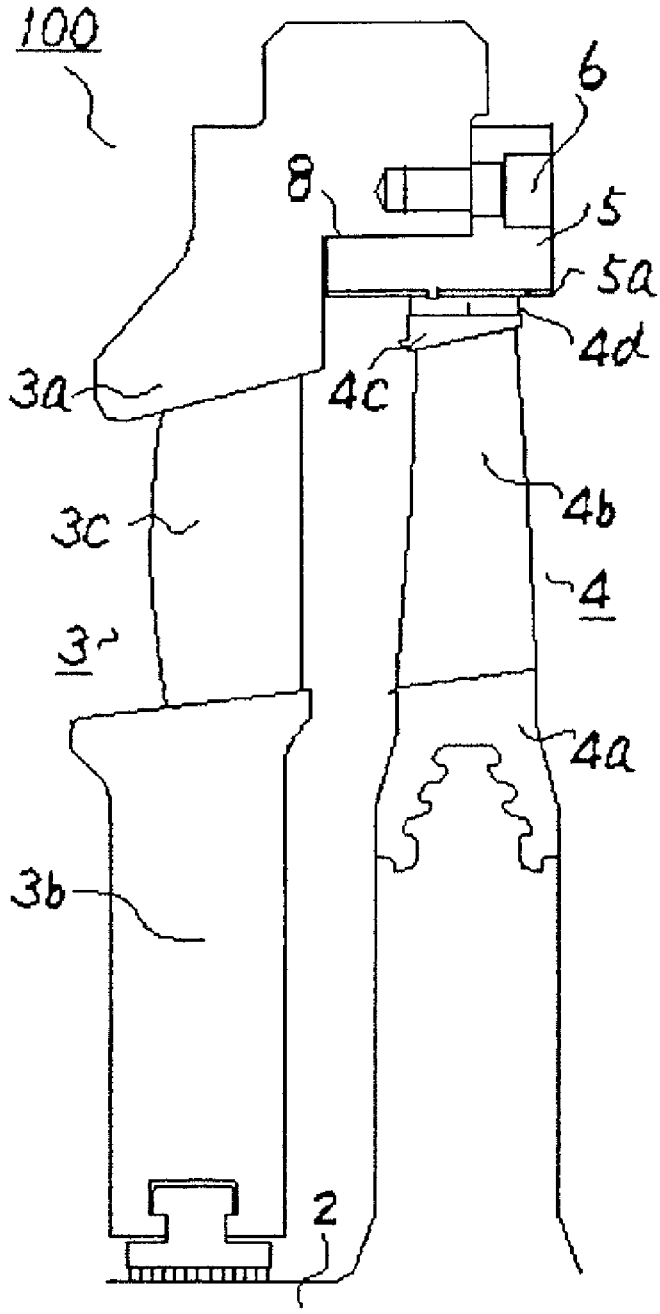
FIG. 4 shows a meridional sectional view showing a turbine stage of a variation of the steam turbine according to the first embodiment of the present invention.
Figure 5:
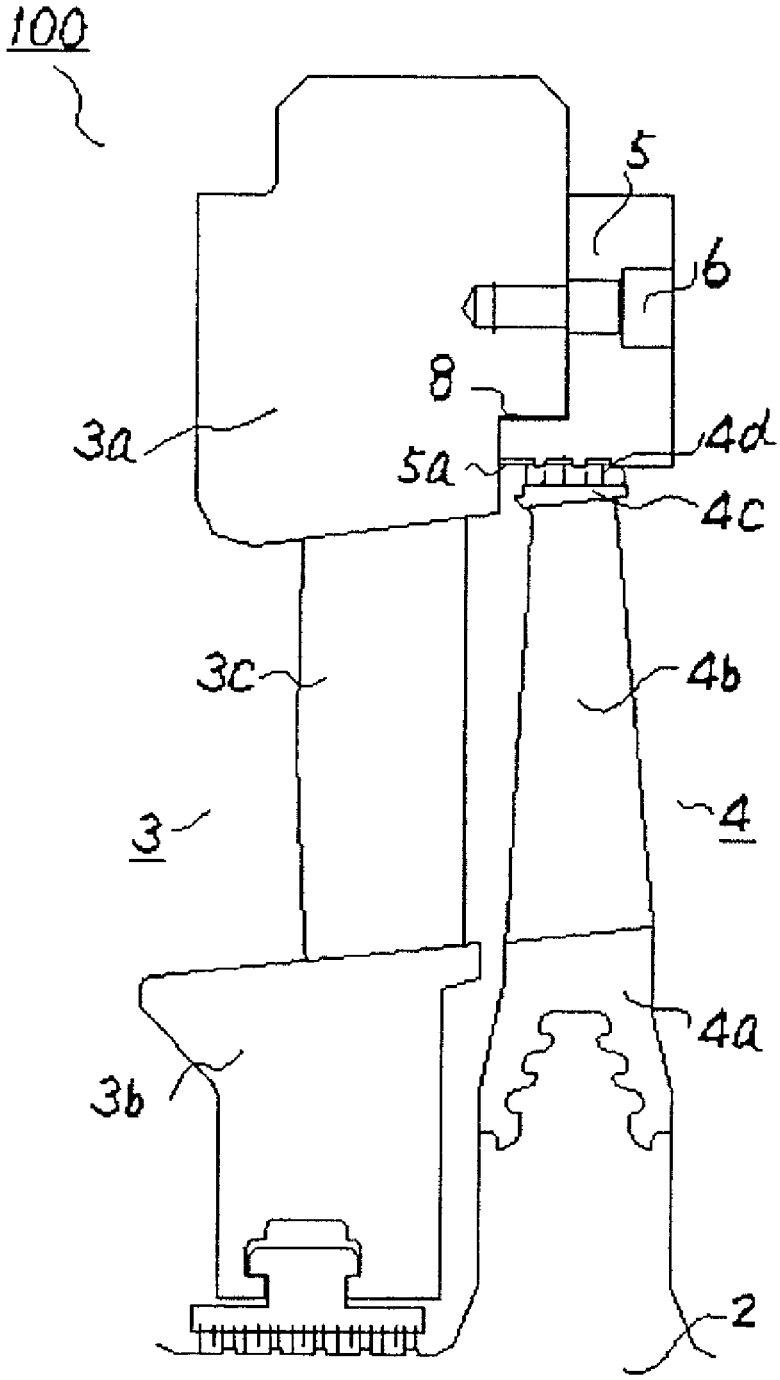
FIG. 5 shows a meridional sectional view showing a turbine stage of another variation of the steam turbine according to the first embodiment of the present invention.

FIGS. 4 and 5 show meridional sectional views showing a turbine stage of variations of the steam turbine according to the embodiment. In FIGS. 4 and 5, parts or components similarly to those shown in FIGS. 1 to 3 are indicated by the same reference numerals, and repetitive explanation will be omitted.

As shown in FIG. 4, in this variation, a step is not formed on the nozzle diaphragm outer ring 3*a*, and a fitting insertion part 8 is formed on the outer circumference side of the abradable structure 5. Then, the insertion part 8 is engaged with the inner circumference end of the nozzle diaphragm outer ring 3*a*, and the abradable structure 5 is rigidly connected to the nozzle diaphragm outer ring 3*a* by the bolts 6.

In this way, by forming the insertion part 8 on the abradable structure 5, and engaging the insertion part 8 with the nozzle diaphragm outer ring 3*a* to rigidly connect the abradable structure 5 thereto, it becomes possible to improve the positional accuracy of the abradable structure 5 with respect to the nozzle diaphragm 3. Accordingly, the cutting range of the abradable part 5*a* can be reduced sufficiently, which can further reduce the amount of the steam leakage.

Furthermore, as shown in FIG. 5, by changing the aspect ratio of the insertion part 8 such that the length along the radial direction is larger than the length along the axial direction, it becomes possible to further reduce a fear that the abradable structure 5 to be rigidly connected will jounce. Accordingly, it becomes possible to sufficiently manage the cutting range of the abradable part 5*a*.

Figure 6:
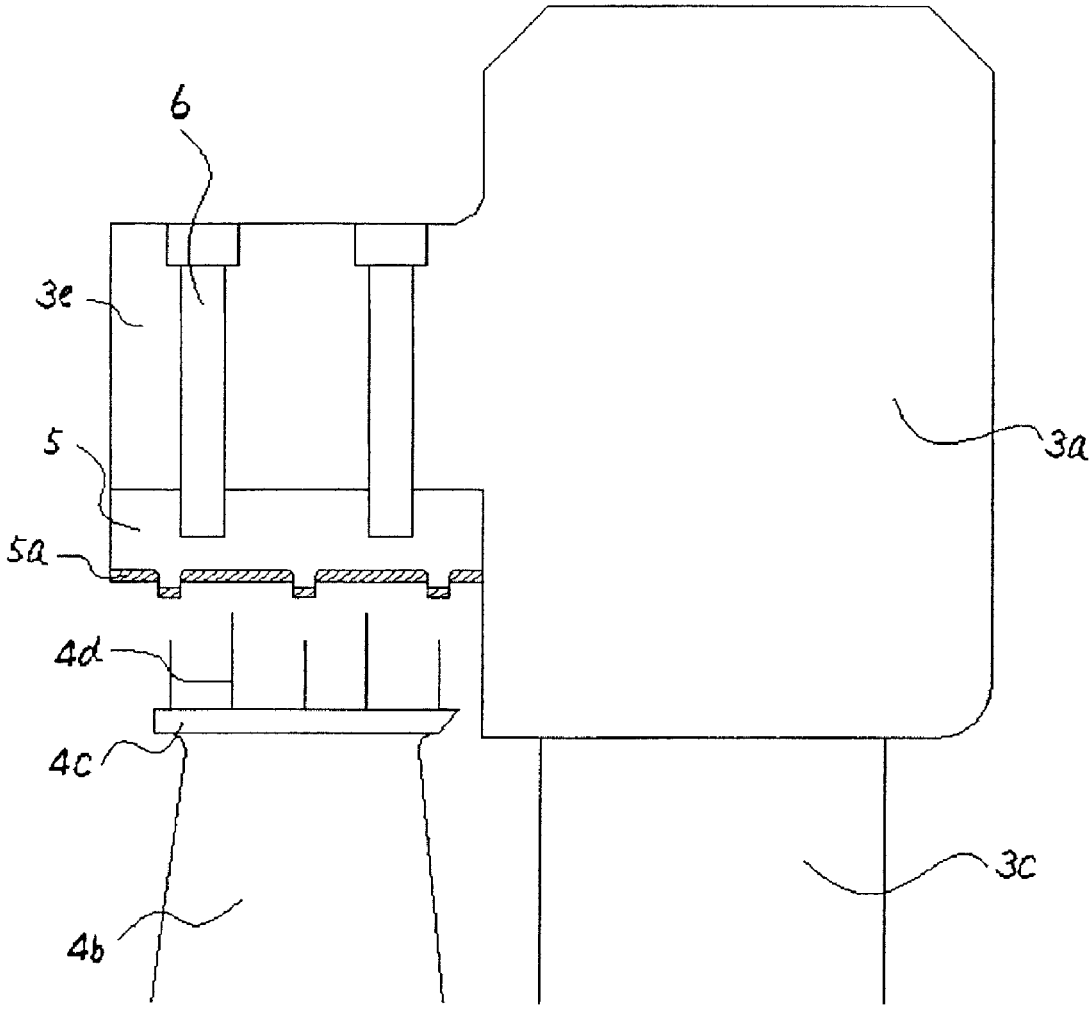
FIG. 6 shows, of the meridional sectional view of yet another variation of the steam turbine according to the first embodiment of the present invention, a schematic view which is obtained by enlarging the seal part of the moving blade tip.
Figure 7:
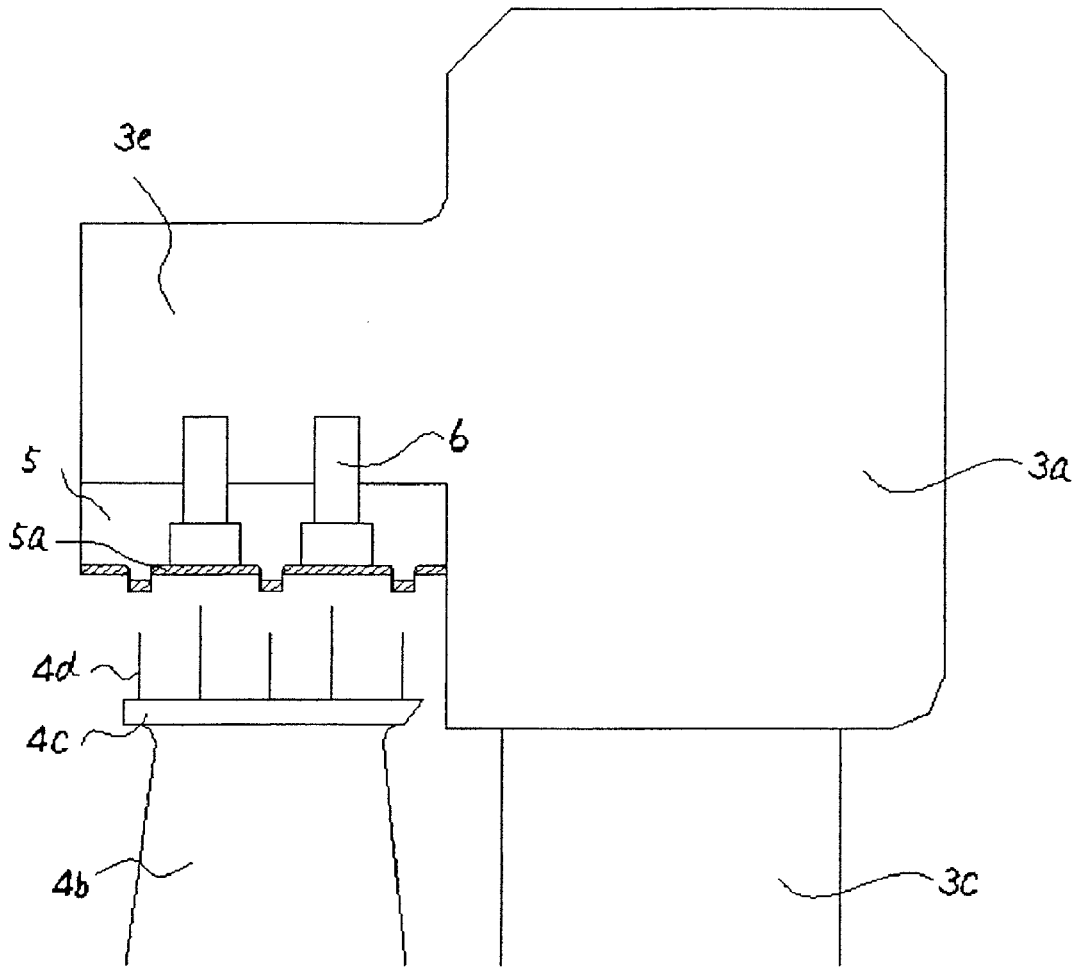
FIG. 7 shows, of the meridional sectional view of yet another variation of the steam turbine according to the first embodiment of the present invention, a schematic view which is obtained by enlarging the seal part of the moving blade tip.

Next, other variations according to the embodiment will be explained referring to FIGS. 6 and 7. FIGS. 6 and 7 show, of the meridional sectional views of other variations of the first embodiment of the steam turbine according to the present invention, schematic views which are obtained by enlarging the seal part of the moving blade tip. In FIGS. 6 and 7, parts or components similarly to those shown in FIGS. 1 to 5 are indicated by the same reference numerals, and repetitive explanation will be omitted.

In these variations, at a position corresponding to the seal strips 4*d* arranged on the moving blade tips 4*c* of the moving blades 4, similarly to the first embodiment shown in FIG. 1, the abradable structure 5 is rigidly connected to the nozzle diaphragm outer ring 3*a* by the bolts 6. In the first embodiment shown in FIG. 1, the abradable structure 5 is coupled by the bolts 6 which are arranged in the axial direction to the downstream side of the nozzle diaphragm outer ring 3*a*. On the other hand, in these variations, on the nozzle diaphragm outer ring 3*a*, a shoulder part 3*e* is arranged on the downstream side with respect to the nozzle blade 3*c*.

In the variations shown in FIGS. 6 and 7, the abradable structure 5 is rigidly connected by the bolts 6 which are arranged on the inner circumference side of the shoulder part 3*e* in the radial direction, and are screwed thereto. Also in these variations, the plural bolts 6 are arranged in the circumferential direction with intervals provided therebetween.

In the variation shown in FIG. 6, the bolts 6 are screwed from the outside in the radial direction. Alternatively, as shown in FIG. 7, the abradable structure 5 can be rigidly connected to the shoulder part 3*e* of the nozzle diaphragm outer ring 3*a* by the bolts 6 from the inner circumference side in the radial direction.

In this way, by arranging the bolts 6 in the radial direction, and rigidly connecting the abradable structure 5 in the radial direction, the size of the abradable structure 5 can be reduced. Furthermore, when the seal strips 4*d* come into contact with the abradable part 5*a* to damage the abradable part 5*a*, the abradable structure 5 can be detached in the radial direction for replacing a new abradable structure 5. Then, the maintenance cost is reduced. Furthermore, since the nozzle diaphragm outer ring 3*a* has the shoulder part 3*e*, the nozzle diaphragm outer ring 3*a* can be provided with a sufficient intensity.

Figure 8:
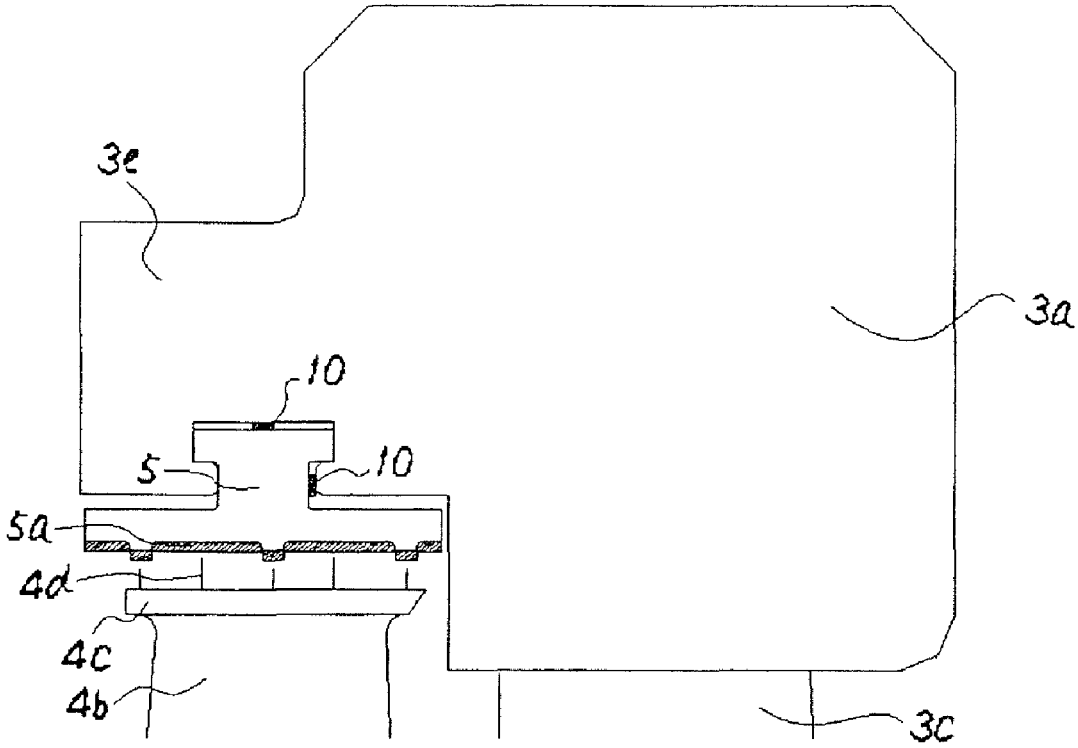
FIG. 8 shows, of a meridional sectional view of a steam turbine according to a second embodiment of the present invention, a schematic view which is obtained by enlarging the seal part of the moving blade tip.

Furthermore, the second embodiment of the present invention will be described with reference to FIG. 8. FIG. 8 shows, of a meridional sectional view of the second embodiment of a steam turbine according to the present invention, a schematic view which is obtained by enlarging the seal part of the moving blade tip.

In this embodiment, the configuration other than the seal part of the moving blade tip is similarly to that of the first embodiment shown in FIG. 1. In FIG. 8, parts or components similarly to those shown in FIGS. 1 to 7 are indicated by the same reference numerals, and repetitive explanation will be omitted.

In the embodiment shown in FIG. 8, similarly to the variations of the first embodiment shown in FIGS. 6 and 7, on the nozzle diaphragm outer ring 3*a*, a shoulder part 3*e* is arranged on the downstream side with respect to the nozzle blade 3*c*. Then, in the shoulder part 3*e*, a concave is provided, and a seal support member segment as an abradable structure 5 is rigidly attached to the concave.

Similarly to the first embodiment shown in FIG. 1, the abradable structure 5 has an abradable part 5*a* arranged on the inner circumference surface thereof at a position facing the seal strip 4*d*. Thus, the seal strip 4*d* and abradable part 5*a* seal steam. On the outer circumference side of the abradable structure 5, which is the opposite side of the abradable part 5*a*, a convex that is to be engaged with the concave formed in the shoulder part 3*e* of the nozzle diaphragm outer ring 3*a* is provided. When the convex is engaged with the concave, the abradable structure 5 is rigidly connected to the nozzle diaphragm outer ring 3*a*.

Especially, in this embodiment, between the convex of the abradable structure 5 and the concave of the nozzle diaphragm outer ring 3*a*, metal pieces 10 are inserted to fix the position in the axial direction and the radial direction. The metal pieces 10 are made of a material which has a higher thermal expansion coefficient as compared with a material such as CrMoV material and 12Cr material which configures the main body of the nozzle diaphragm 3 and abradable structure 5. Typical example of such material includes aluminum and stainless series materials.

In this way, by inserting the metal pieces 10 with high in thermal expansion coefficient, in the engagement part of the nozzle diaphragm outer ring 3*a* and abradable structure 5, the metal pieces expand in the steady operation to remove small clearances in the axial direction and in the radial direction. Accordingly, the abradable structure 5 can be rigidly connected to the nozzle diaphragm outer ring 3*a* without raising a jounce.

Accordingly, similarly to the first embodiment, the position of the abradable structure 5 with respect to the nozzle diaphragm 3 does not shift in the radial direction or in the axial direction. Thus, a situation is evaded in which the abradable layer jounces to be largely cut even in the transient state. So, part of the abradable part 5*a* to be cut can be suppressed to the minimum, which can further reduce the amount of leaked steam.

Furthermore, similarly to the first embodiment, the abradable structure 5 is separately arranged from the nozzle diaphragm 3, and is attached to the nozzle diaphragm outer ring 3*a*. Therefore, when the seal strips 4*d* come into contact with the abradable part 5*a* to damage the abradable part 5*a*, the repair work can be easily performed comparatively.

Furthermore, according to the embodiment, as the structure other than the abradable structure 5, the structure of the conventional turbine stage can be used. Therefore, the present invention can be easily implemented for repairing an existing steam turbine.

In this embodiment, the metal pieces 10 with a high thermal expansion coefficient are inserted between the concave of the nozzle diaphragm outer ring 3*a* and the convex of the abradable structure 5 without a jounce. Alternative configurations may be employed so long as the abradable structure 5 and the nozzle diaphragm outer ring 3*a* are connected to each other rigidly.

That is, by selecting the material configuring the convex of the abradable structure 5 with a thermal expansion coefficient larger than that of the material configuring the concave of the nozzle diaphragm outer ring 3*a*, even if the metal pieces 10 are not used, the convex of the abradable structure 5 can be rigidly engaged with the concave of the nozzle diaphragm outer ring 3*a* due to the thermal expansion at the time of the operation. Alternatively, in engaging the convex of the abradable structure 5 with the concave of the nozzle diaphragm outer ring 3*a*, the rigid connection can be realized by using various heretofore known methods. The methods may include a method where the abradable structure 5 is attached to the nozzle diaphragm outer ring 3*a* without a jounce by using a cooling fit.

Furthermore, in the embodiment shown in FIG. 8, a concave is provided in the nozzle diaphragm outer ring 3*a*, and a convex is provided on the abradable structure 5, and they are engaged with each other. Alternatively, there may be employed a configuration in which a convex is provided on the nozzle diaphragm outer ring 3*a*, and a concave is provided in the abradable structure 5, and they are engaged with each other to be rigidly connected.

The embodiments of the steam turbine in accordance with the present invention explained above are merely samples, and the present invention is not restricted thereto. It is, therefore, to be understood that, within the scope of the appended claims, the present invention can be practiced in a manner other than as specifically described herein.

What is claimed is:

1. A steam turbine comprising:

a casing;

a rotor rotatably arranged in the casing;

at least one nozzle diaphragm substantially concentrically arranged with respect to the rotor, the nozzle diaphragm being engaged with the casing;

a plurality of moving blades arranged in circumferential direction on outer circumference of the rotor at positions adjacent to the nozzle diaphragm;

one or more seal strips circumferentially extending on tips of the moving blades, the seal strips protruding in radial outward direction; and an abradable structure rigidly connected to the nozzle diaphragm, the abradable structure facing the seal strips in radial direction at a facing surface and having an abradable part made of an abradable material arranged at the facing surface.

2. The steam turbine according to claim 1, wherein the abradable structure is separated into plural parts arranged in the circumferential direction.

3. The steam turbine according to claim 1, wherein the abradable structure is fixed to the nozzle diaphragm by bolts.

4. The steam turbine according to claim 3, wherein the bolts are arranged in axial direction with respect to the rotor, and fix the abradable structure to the nozzle diaphragm.

5. The steam turbine according to claim 3, wherein the bolts are arranged in the radial direction with respect to the rotor, and fix the abradable structure to the nozzle diaphragm.

6. The steam turbine according to claim 1, wherein the abradable structure is fit to the nozzle diaphragm.

7. The steam turbine according to claim 6, further comprising at least one member piece inserted in fitting part between the abradable structure and the nozzle diaphragm, the member piece being made of a material with a larger thermal expansion coefficient as compared with that of a material configuring the nozzle diaphragm.

8. The steam turbine according to claim 1, wherein the seal strips are formed by cutting a structure arranged on the tips of the moving blades.

9. The steam turbine according to claim 1, wherein the seal strips are embedded to the tips of the moving blades to be formed.

* * * * *